US007350656B2

(12) United States Patent
Hidding

(10) Patent No.: US 7,350,656 B2
(45) Date of Patent: Apr. 1, 2008

(54) PROBE ACTUATED BOTTLE CAP

(75) Inventor: Douglas J. Hidding, Barrington Hills, IL (US)

(73) Assignee: Blackhawk Molding Co., Inc., Addison, IL (US)

( * ) Notice: Subject to any disclaimer, the term of this patent is extended or adjusted under 35 U.S.C. 154(b) by 461 days.

(21) Appl. No.: 10/896,576

(22) Filed: Jul. 22, 2004

(65) Prior Publication Data

US 2006/0016777 A1 Jan. 26, 2006

(51) Int. Cl.
*B65D 53/00* (2006.01)

(52) U.S. Cl. ..... 215/350; 215/303; 215/253; 215/347; 215/265; 215/256; 222/81

(58) Field of Classification Search ..... 215/350, 215/253, 347, 303, 265, 227, 310, 232, 256, 215/254; 220/359.3, 359.4; 222/81
See application file for complete search history.

(56) References Cited

U.S. PATENT DOCUMENTS 1,241,352 A 9/1917 Deoring et al.
4,312,695 A * 1/1982 Willis ..... 156/344
4,597,423 A 7/1986 Chenot ..... 141/330
4,846,236 A 7/1989 Deruntz ..... 141/329
4,874,023 A * 10/1989 Ulm ..... 141/346
5,123,555 A * 6/1992 Luch et al. ..... 215/256
5,295,518 A * 3/1994 Baker et al. ..... 141/18
5,370,270 A * 12/1994 Adams et al. ..... 222/88
5,513,763 A * 5/1996 Adams et al. ..... 215/254
5,526,961 A 6/1996 Burrows ..... 222/185.1
5,542,555 A * 8/1996 Hidding et al. ..... 215/265
5,544,770 A * 8/1996 Travisano ..... 215/230
5,687,865 A * 11/1997 Adams et al. ..... 215/253
5,687,867 A * 11/1997 Lamoureux ..... 215/303
5,743,420 A * 4/1998 Loffler et al. ..... 215/270
5,904,259 A * 5/1999 Hidding et al. ..... 215/232
5,937,921 A * 8/1999 Guglielmini ..... 141/351
5,957,316 A * 9/1999 Hidding et al. ..... 215/265
5,992,658 A * 11/1999 Berger ..... 215/232
6,032,812 A * 3/2000 Lamoureux ..... 215/303
6,123,122 A * 9/2000 Dushman ..... 141/348
6,308,849 B1 * 10/2001 Kim ..... 215/303
6,408,904 B1 * 6/2002 Dushman ..... 141/352
6,457,613 B1 * 10/2002 Patterson ..... 222/494

(Continued)

*Primary Examiner*—Anthony Stashick
*Assistant Examiner*—Christopher McKinley
(74) *Attorney, Agent, or Firm*—David I. Roche; Daniel A. Tallitsch; Baker & McKenzie LLP

(57) ABSTRACT

A cap for use with bottled water dispensing systems. The cap includes a main cap and a liner. The main cap has an opening which receives and seals against a probe. The liner is gripped between the main cap and the bottle neck and has a outside part and an inner movable part. The inner movable part is separated from the outer part by perforations and is connected to the outer part by a large connecting section, which serves as a hinge, and small connecting sections, which serve as frangible ties. When the bottle is lowered onto the dispensing system, the probe enters into the opening in the main cap, breaks the frangible ties, and pushes the inner movable part open like a flap. The liner, at the location of the large connecting section, is resilient such that the inner movable part tends to close when the bottle is removed from the dispensing system.

27 Claims, 3 Drawing Sheets

U.S. PATENT DOCUMENTS 6,488,165 B1 * 12/2002 Hidding ..... 215/344
6,508,375 B1 * 1/2003 Krall ..... 220/359.1
6,921,003 B2 * 7/2005 Yu ..... 222/185.1
2003/0189023 A1 * 10/2003 Gonzalez ..... 215/260
2004/0060892 A1 * 4/2004 Heston et al. ..... 215/254
2005/0167391 A1 * 8/2005 Michiels et al. ..... 215/303
2005/0269281 A1 * 12/2005 Ding ..... 215/254
2006/0201905 A1 * 9/2006 Perrin et al. ..... 215/253

* cited by examiner

PROBE ACTUATED BOTTLE CAP

BACKGROUND OF THE INVENTIONS

The inventions described and claimed herein relate generally to bottle caps which form closures for use in the bottled water industry and which are capable of receiving a dispensing probe.

Valved bottle caps, such as those shown in U.S. Pat. Nos. 5,370,270; 5,392,939; 5,542,555; 5,687,867; 5,904,259 and 5,957,316, have been used in conjunction with a probe dispensing system for a number of years. Valved closures for bottled water solve problems relating to the growth of bacteria in the dispensing system reservoirs and solve the problem of spilling water when the bottle is initially installed on the dispensing system. Current valved bottle caps generally consist of a molded bottle cap with a central tube section, a separately molded inner cap or plug which is initially engaged with the central tube section, a liner to provide a seal at the bottle neck, and a label affixed to the outside of the cap to prevent contaminants from entering the central tube section, which contaminants will commingle with the contents of the bottle when the bottle is inverted onto a cooler. When a bottle is installed on a dispensing system, the dispensing probe is directed into the central tube section, the inner cap moves from engagement with the central tube into engagement with the probe, and the inner cap moves out of engagement with the central tube section effectively opening the bottle so that water can escape the bottle through the probe and into a reservoir in the dispenser. As the bottle is removed from the dispenser, the cap is lifted from the probe, and the inner cap reengages with the central tube section to block debris from being dropped into the otherwise open top of the container as the empty container awaits retrieval by the bottler for re-use.

There are some problems associated with the use of valved bottle caps. Occasionally, an inner cap will not engage correctly with the probe when the bottle is installed on a water dispensing system or with the central tube when the bottle is removed from the water dispensing system. This condition is known in the bottled water industry as a container with a "floater". In the first instance, the inner cap will float to the top of the water and will give the impression that the water is not sanitary. In addition, when there is a failure of engagement between the probe and the inner cap or plug there will be no inner cap or plug to block the dropping of debris into the empty bottle during the period that the empty bottle is awaiting pick-up by the bottling company. Even if the probe and inner cap or plug successfully engage upon the installation of a full bottle onto the dispenser, it is still possible for there to be a failure for the probe and inner cap or plug to re-engage when the bottle is removed from the dispenser. If there is an open pathway through the central tube during the period when an empty bottle is awaiting pick-up, there is a significant chance that people will deposit garbage, cigarette butts, gum, etc., into the empty container as they approach the dispenser—using the empty bottle as a sort of trash container. When a bottle contains such debris, the bottler who wants to re-use the bottle has a significantly more difficult time cleaning the bottle, as compared to a bottle that has not been used as a trash container.

Users have also experienced difficulty in removing the bottle from the dispensing system, especially when pulling the bottle off at an angle. The length of the central tube may create too great a grip on the probe making removal of the bottle difficult. When this occurs, greater force may be needed to remove the bottle, which may then cause the bottle to disengage from the probe suddenly causing the bottle to hit the user on the face.

Dispensing probes are often specially designed to mate with specific inner caps, and a bottler may be supplying customers with different probes. Even when a bottler delivers water to customers who have "standard" probes (0.75 inches in diameter), there may be variability in the ease or difficulty with which the central tube engages and disengages with such probes, in part because of the length of the central tube or because of the way in which the inner cap or plug engages or disengages the probe. Because bottlers are increasingly required to deal with probes and dispensing systems from multiple manufacturers, it is desirable to have a cap for their bottles that can readily accommodate the variability that exists in the systems of their customer base. Also, valved bottle caps can be costly compared to a cap molded as a single component. Providing a separate component in the form of an inner cap or plug means that there will be additional raw material required and will require the operation and maintenance of the molding equipment needed to manufacture that component. In addition, providing the inner cap or plug as a separate component means that there is both labor and equipment needed to pre-attach the inner cap or plug to the central tube.

SUMMARY OF AN EXAMPLE OF THE INVENTIONS

The closures described and claimed herein not only provide the benefits of the current valved bottle caps in that they prevent bacteria transfer to the dispensing reservoir and spillage during bottle installation, but they also solve some of the problems associated with the valved bottle caps. First, these caps will have no "floaters" because there are no removable parts. Second, these caps will be closed when removed from the dispensing system, at least visually. Third, these caps will disengage from the probe more easily because they will not grip the probe as tightly as the valved bottle caps having extended central tubes, and there will be no inner cap or plug that has to snap into place on the probe. Fourth, these caps will be is less costly to use because the inner cap is eliminated. Elimination of the inner cap will not only save plastic, it will also save an entire molding operation, an assembly step, and equipment operation and maintenance. Further, it may be less expensive to manufacture the probe because the retaining slot on the end is no longer needed. Last, these caps are compatible with various manufacturer's probes that have an industry standard diameter of about 0.75 inches.

The caps described herein are comprised of two parts. The first part is a main cap body, and is comprised of a generally cylindrical skirt extending from and integrally formed with an annular top. The opening in the annular top is designed to receive a dispensing probe of standard diameter. The diameter of the opening is not greater than the diameter of the dispensing probe such that a seal is formed when the bottle cap is lowered onto the probe. Optional or alternative means for sealing against the probe include increasing the thickness of the lid in the axial direction at the edge of the opening, reducing the thickness of the lid in the axial direction at the edge of the opening, and attaching a lip seal at the edge of the opening.

The caps described herein have an outer skirt and a lid with a central opening. From the outside, a membrane or other label covers the opening in the lid. The cap includes a liner connected to the underside of the lid of the cap. The liner includes an inner movable part covering the opening from the inside of the cap, and an outer part gripped between the underside of the lid and the container. When gripped between the lid and the neck of the container, the outer part not only holds the inner movable part in place at the opening but also provides a seal to prevent leakage along the skirt and the container. The inner movable part is larger than the opening to prevent liquid flow through the opening when the container is turned on its side during transit and when the container is inverted during installation onto the dispensing system. The static pressure of the container contents will tend to seal the inner movable part against the underside of the lid effectively preventing flow through the opening. Optionally, a raised surface can be molded onto the inside surface to concentrate the static force at a reduced contact area between the inner movable part and the lid. One of the connecting sections is relatively large and serves as a hinge for the inner movable part such that the inner movable part forms a flap as the bottle cap is lowered onto the probe. Optional small connecting sections could take the form of frangible ties which hold the inner movable part in place until they are broken by lowering the cap onto the probe. Alternatively, the connecting sections could remain attached to the inner movable part and be made out of an elastic material such that the connecting sections stretch when the cap is lowered onto the probe.

An optional but preferable feature is a protective tamper evident membrane seal which is attached to the top of the lid, such as that shown in U.S. Pat. No. 5,904,259. The tamper evident seal prevents dirt from coming into contact with the parts of the cap which then come into contact with the probe.

These and other features and advantages of the inventions will be better understood upon a reading of the following detailed description of the drawings read in conjunction with the accompanying drawings, wherein:

DETAILED DESCRIPTION OF THF DRAWINGS

Figure 2:
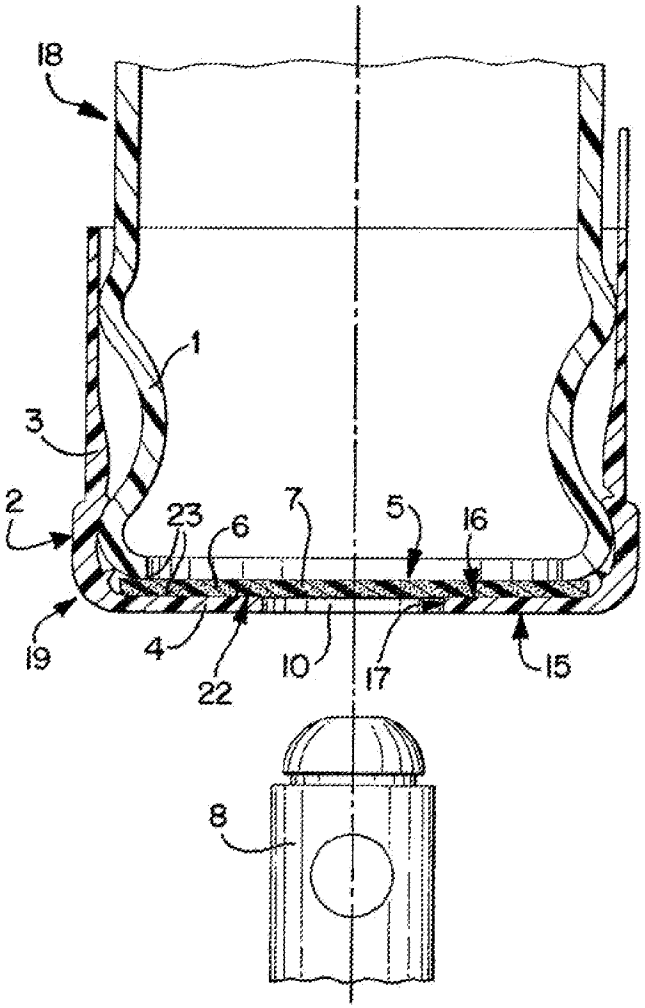
FIG. 2 is a sectional view showing a cap installed on a container neck just prior to its placement over a probe.
Figure 1:
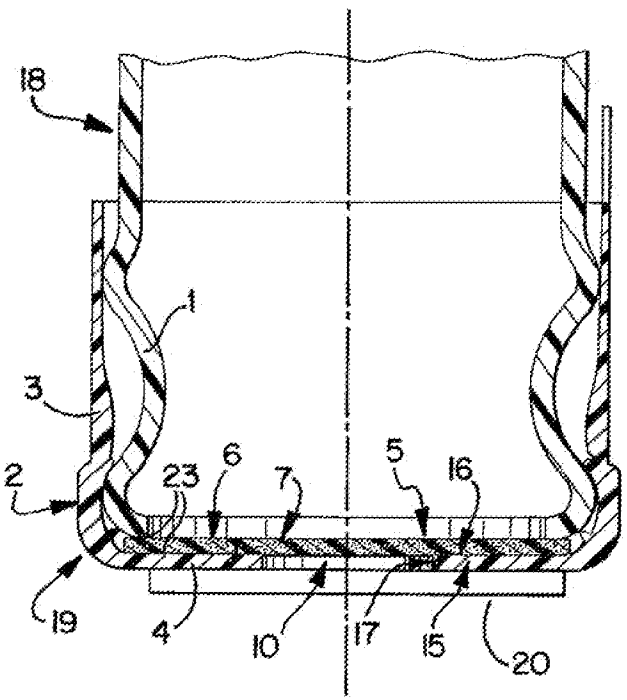
FIG. 1 is a sectional view showing a cap installed on a container neck.
Figure 3:
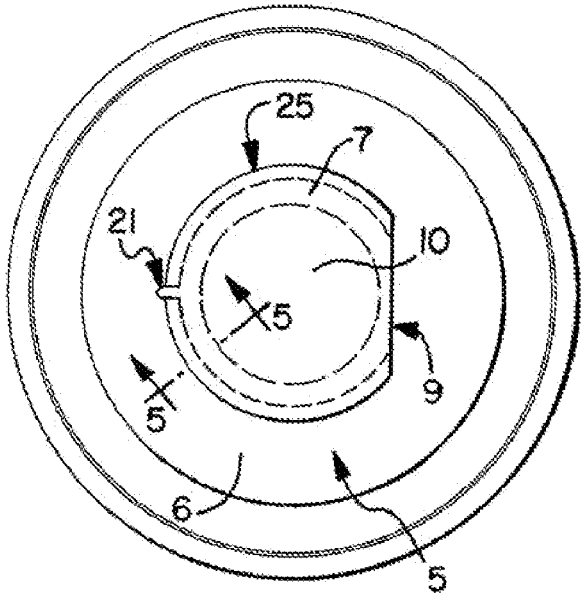
FIG. 3 is a bottom plan view of the cap shown in FIG. 1.

FIGS. 1, 2 and 3 show a container 18 with a bottle neck 1 onto which has been placed one embodiment of a cap 19. The cap 19 is comprised of three components, a cap body 2, a foam liner 5, and a membrane 20. The cap body 2 has an integral lid 4, a skirt 3 extending from the lid 4, an opening 10 in the center of the lid 4. The lid 4 has an underside 16, a top 15, and an inside edge 17. A protective tamper evident sealing membrane 20 is affixed to the top 15 of the lid 4 to prevent dirt from coming into contact with the top 15 of the lid 4 and entering the opening 10. It is preferable that the seal 20 be attached to the top 15 by a heat seal such that a water tight connection is formed between the lid 4 and the membrane 20. Other ways of forming a water tight seal between the membrane 20 and the lid 4 could be used, such as those discussed in U.S. Pat. No. 5,904,259, which is incorporated herein by reference.

FIG. 3 is a plan view of the inside of a cap 19 showing the liner 5 disposed at the underside 16 of the lid 4. The liner 5 has a radially outer part 6 and a radially inner movable part 7 which is connected to the outer part 6 by one large connecting section 9 and, optionally, by one or more small connecting sections 21. The outer part 6 is separated from the inner movable part 7 by at least one cut 25, which in this instance is all the way through the thickness of the liner 5, but which may extend only partially through that thickness.

Figure 4:
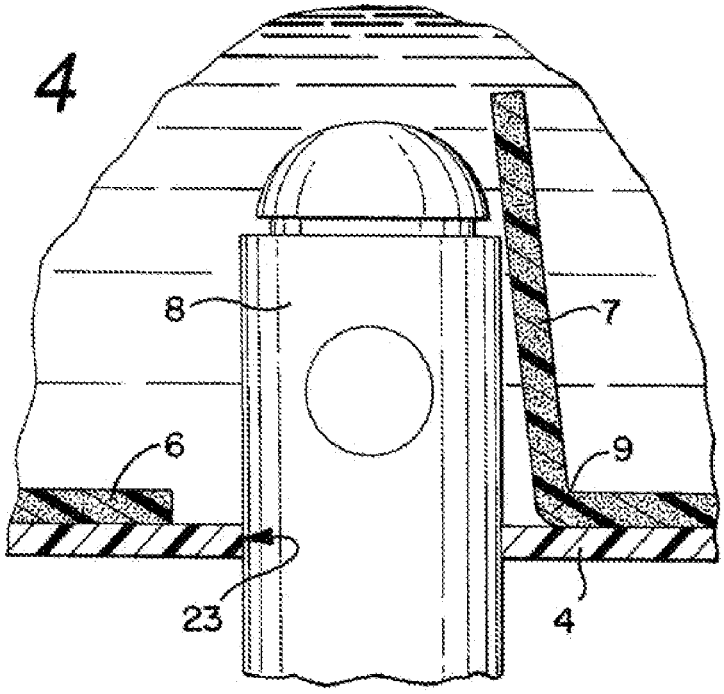
FIG. 4 is an enlarged sectional view showing the inner movable part and portions of the outer part and lid, together with a dispensing probe, while engaged with the probe.

FIG. 2 shows the cap 19 after the protective tamper evident seal membrane 20 has been removed and just prior to its placement over a dispensing probe 8, which is part of a dispensing system (not shown). Examples of dispensing systems with probes for which the caps described and claimed herein are applicable can be seen in U.S. Pat. Nos. 5,653,270 and 5,289,855, which are incorporated herein by reference. As the cap 19 is lowered into the dispenser, the probe 8 enters the opening and breaks the small connecting section 21, if present. As the cap 19 is further lowered, the large connecting section 9 forms a hinge about which the inner movable part rotates. FIG. 4 shows the fully displaced or "up" position of the inner moveable part 7 of the liner 5, which exists when bottle is fully installed onto the dispensing system and the probe is fully engaged with the cap 19. As can be seen in the '270 and the '855 patents, the probe 8 typically extends farther into the container than is shown in FIG. 4. As the cap 19 and the container 18 to which it is attached are lifted off of the probe 8, the inner movable part 7 returns essentially to its original position as shown in FIG. 2, because the liner 5 is made from a resilient material.

A material that is suitable for a foam liner 5 is a foamed sheet material made of cross-linked closed cell polyethylene and having a thickness of about 0.125 inches. Cross-linked polyethylene is typically made with a blowing agent called SEM, which is somewhat controversial in the water bottling industry. Thus, it may be advantageous to use an SEM-free cross-linked polyethylene, which is a more dense and thinner material. SEM-free cross-linked polyethylene is also a more stiff material which may result in improved performance of the flap. If a seal is desired between the neck 1 of the 18 and the outer periphery of the underside 16 of the lid 4, then a disk about 2.3 inches in diameter is preferred. This diameter will allow the liner to be held or wedged into place such that it will retain itself in position during shipment of the cap 19 a capping operation in which the cap 19 may be moved in a vibrating feeder into position so that it can be pressed into place onto the neck 1 of a container 18. However, many other materials more or less dense materials could be used as a liner material. The liner material preferably has enough stiffness and strength to form a short term flapper valve over the opening 10 during the rather brief period just prior to the installation of a new container of water onto a dispenser. In that brief period, the sealing membrane 20 has been removed from the top 15 of the lid 4, and the bottle is inverted. At that moment, which may typically last for less than 30 seconds, it is preferable to prevent large flow of water out of the container 18 through the opening 10. The seal between the inner moveable part 7 of the liner 5 and the underside 16 of the lid 4 need not be a perfect seal. Indeed a moderate amount of water passing through the opening 10 as the bottle is inverted will still be acceptable. The sealing effect to the liner may be enhanced by making the cut in the liner in a generally frustoconical shape, preferably at 65°, such that the opening in the liner formed by the cuts is smaller on the side of the liner that abuts the underside 16 of the lid 4 than the opening in the liner on the side away from the lid. The inner movable part 7 is larger than the opening 10, preferably with a diameter of 1.012 inches, such that static pressure will tend to form a first seal 22 where the inner movable part 7 overlaps with the underside 16 of lid 4 as the container 18 is inverted or on its side, preventing flow through the opening 10. FIG. 1 and FIG. 2 show that the outer part 6 of the liner 5 is gripped between the bottle neck 1 and the underside 16 of the lid 4 forming a second seal 23 to prevent leakage between the skirt 3 and the bottle neck 1.

The opening 10 has a diameter not greater than that of a standardprobe 8, which has a diameter of approximately 0.75 inches, so that a third seal 24 is formed when the cap 19 is lowered onto the probe 8, as shown in FIG. 4. Depending upon the softness and flexibility of the material of which the cap 19 is made, the opening 10 should be less than the diameter of the probe onto which the cap will be installed. For caps made of low density polyethylene, it has been found that a hole with a diameter that is 0.734 inches (or 0.016 inches less than the diameter of a standard probe) forms a sufficient seal between the cap and the probe, and allows removal of the bottle and cap from the probe with an appropriate amount of pulling force.

Figure 9:
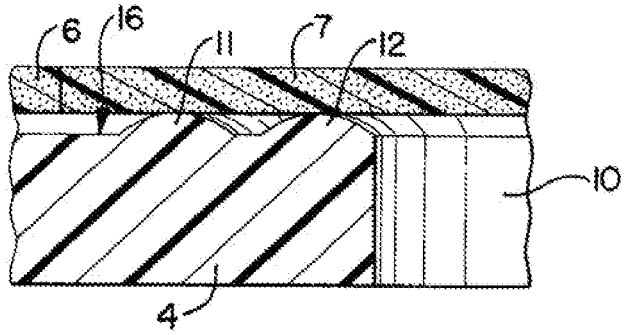
FIG. 9 is an enlarged sectional view of showing an alternative embodiment of the inside surface of the lid, which seals against the probe when the container is installed on the dispensing system, and an alternative embodiment of the underside of the lid, which seals against the inner movable part prior to engagement with the probe.

To enhance the first seal 22, an optional raised surface 11 can be molded onto the underside 16 of the lid 4 which will concentrate the static force between the inner movable part 7 and the lid 4, as shown in FIG. 9. In addition, the first seal 22 can be enhanced by making the perforations 25 at an angle such that the outer part 6 and the inner movable part 7 have tapered surfaces 26 that mate when the inner movable part 7 is closed.

Figure 5:
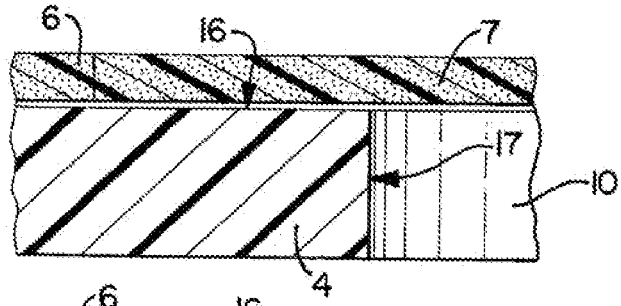
FIG. 5 is an enlarged sectional view of showing an alternative embodiment of the inside surface of the lid, which seals against the probe when the container is installed on the dispensing system.
Figure 6:
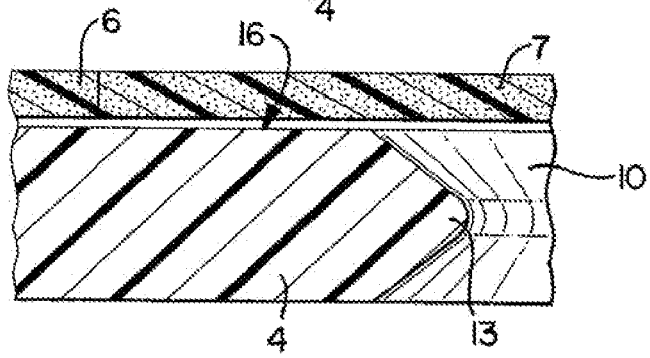
FIG. 6 is an enlarged sectional view of showing an alternative embodiment of the inside surface of the lid, which seals against the probe when the container is installed on the dispensing system.
Figure 7:
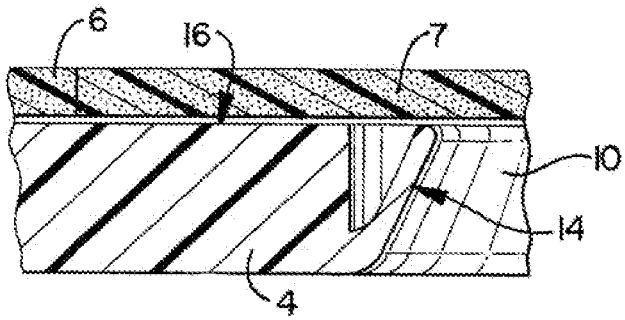
FIG. 7 is an enlarged sectional view of showing an alternative embodiment of the inside surface of the lid, which seals against the probe when the container is installed on the dispensing system.
Figure 8:
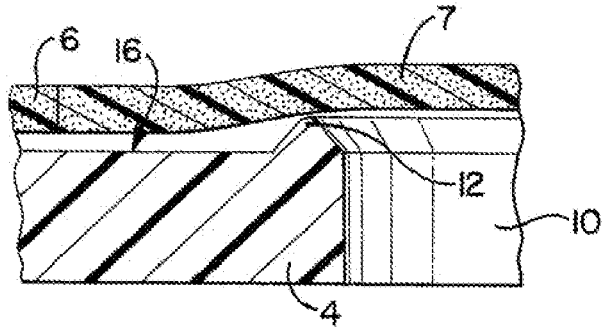
FIG. 8 is an enlarged sectional view of showing an alternative embodiment of the inside surface of the lid, which seals against the probe when the container is installed on the dispensing system.

The shape of the inside surface 17 of the lid 4 can be varied to enhance the third seal 24, as shown in FIGS. 5-9. In one embodiment, the inside surface 17 can be parallel with the axis of the lid 4 and can have a thickness in the axial direction equal to that of the lid 4, as shown in FIG. 5. Alternatively, the inside surface 17 of the lid can have either an increased thickness 12 or a decreased thickness 13 in the axial direction greater than or less than the thickness of the lid 4 as shown in FIG. 8 and FIG. 6, respectively. In yet another embodiment, a lip 14 can be attached to the inside surface 17 of the lid 4 whereby the static pressure of the fluid tends to force the lip 14 against the probe 8 when the cap 19 is inverted and installed on the dispensing system, as shown in FIG. 7. An increased thickness 12 at the inside surface 17 can have an additional function of enhancing the first seal, similar to the raised portion 11, as discussed above. Alternatively, an increased thickness 12 can be used in conjunction with a raised surface 11, as shown in FIG. 9, providing enhanced sealing around the probe 8, when installed, and a double seal around the opening 10 when the probe 8 is removed.

I claim:

1. A bottle cap for a container, the cap being capable of receiving a probe which is part of a dispensing system, the cap comprising:

a lid having an opening that receives the probe of the dispensing system;

a skirt extending from the lid;

a liner on the underside of the lid;

the liner having an outer part and an inner movable part connected to the outer part by at least one connecting section;

the inner movable part forming a first seal against an underside of the lid to prevent flow through the opening;

the outer part of the liner is gripped between the container and the lid forming a second seal;

the at least one connecting section is formed by one large connecting section and at least one small connecting section; and, the large connecting section forms a hinge and the at least one small connecting section forms at least one tie which is broken upon engagement of the cap with the probe so as to form the inner movable part into a flap.

2. A cap in accordance with claim 1 wherein:

the inner movable part, the large connecting section, and the at least one small connecting section are formed by at least one perforation in the liner.

3. A cap in accordance with claim 2 wherein:

the underside of the lid has a raised portion surrounding the opening which engages with the inner movable part to form the first seal.

4. A cap in accordance with claim 3 wherein:

the opening is not greater than the diameter of a standard probe to form a third seal when the bottle is lowered onto the probe.

5. A cap in accordance with claim 4 wherein:

the liner at the location of the at least one connecting section is resilient such that the inner movable part tends to close upon removal of the probe.

6. A cap in accordance with claim 5 wherein:

an inside surface of the lid has an increased thickness in the axial direction that is greater than the thickness of the lid to enhance the third seal.

7. A cap in accordance with claim 5 wherein:

the inside surface of the lid has a decreased thickness in the axial direction that is less than the thickness of the lid to enhance the third seal.

8. A cap in accordance with claim 5 wherein:

A lip at the inside surface of the lid extends into the opening to enhance the third seal.

9. A cap in accordance with claim 5 wherein:

A protective tamper evident seal is attached to a top of the lid.

10. A cap in accordance with claim 9 wherein:

The at least one perforation is tapered to enhance the second seal.

11. A bottle cap for a container, the cap being capable of receiving a probe which is part of a dispensing system, the cap comprising:

a lid having an opening that receives the probe of the dispensing system;

a skirt extending from the lid;

a liner on the underside of the lid;

the liner having an outer part and an inner movable part connected to the outer part by at least one connecting section;

the inner movable part forming a first seal against an underside of the lid to prevent flow through the opening;

the outer part being gripped between the container and the lid to form a second seal;

the opening being not greater than the diameter of a standard probe to form a third seal when the bottle is lowered onto the probe;

the at least one connecting section is formed by one large connecting section and at least one small connecting section; and, the large connecting section forms a hinge and the at least one small connecting section forms at least one tie which is broken upon engagement of the cap with the probe so as to form the inner movable part into a flap.

12. A cap in accordance with claim 11 wherein:

the inner movable part, the large connecting section, and the at least one small connecting section are formed by at least one perforation in the liner.

13. A cap in accordance with claim 12 wherein:

the underside of the lid has a raised portion surrounding the opening which engages with the inner movable part to form the first seal.

14. A cap in accordance with claim 13 wherein:

the liner at the location of the at least one connecting section is resilient such that the inner movable part tends to close upon removal of the probe.

15. A cap in accordance with claim 14 wherein:

an inside surface of the lid has an increased thickness in the axial direction that is greater than the thickness of the lid to enhance the third seal.

16. A cap in accordance with claim 14 wherein:

the inside surface of the lid has a decreased thickness in the axial direction that is less than the thickness of the lid to enhance the third seal.

17. A cap in accordance with claim 14 wherein:

a lip at the inside surface of the lid extends into the opening to enhance the third seal.

18. A cap in accordance with claim 11 wherein:

a protective tamper evident seal is attached to a top of the lid.

19. A cap in accordance with claim 18 wherein:

the inner movable part, the large connecting section, and the at least one small connecting section are formed by at least one perforation in the liner; and the at least one perforation is tapered to enhance the second seal.

20. A bottle cap for a container, the cap being capable of receiving a probe which is part of a dispensing system, the cap comprising:

a lid having an opening that receives the probe of the dispensing system;

a skirt extending from the lid;

a liner on the underside of the lid;

a protective tamper evident seal is attached to a top of the lid;

the liner having an outer part and an inner movable part connected to the outer part by one large connecting section and at least one small connecting section;

the large connecting section forms a hinge and the at least one small connecting section forms a tie which is broken upon engagement of the cap with the probe so as to form the inner movable part into a flap;

the inner movable part forming a first seal against an underside of the lid to prevent flow through the opening;

the outer part being gripped between the container and the lid to form a second seal; and, the opening being not greater than the diameter of a standard probe to form a third seal when the bottle is lowered onto the probe.

21. A cap in accordance with claim 20 wherein:

the inner movable part, the large connecting section, and the at least one small connecting section are formed by at least one perforation in the liner.

22. A cap in accordance with claim 21 wherein:

the underside of the lid has a raised portion surrounding the opening which engages with the inner movable part to form the first seal.

23. A cap in accordance with claim 22 wherein:

the liner at the location of the at least one connecting section is resilient such that the inner movable part tends to close upon removal of the probe.

24. A cap in accordance with claim 23 wherein:

an inside surface of the lid has an increased thickness in the axial direction that is greater than the thickness of the lid to enhance the third seal.

25. A cap in accordance with claim 23 wherein:

the inside surface of the lid has a decreased thickness in the axial direction that is less than the thickness of the lid to enhance the third seal.

26. A cap in accordance with claim 23 wherein:

A lip at the inside surface of the lid extends into the opening to enhance the third seal.

27. A cap in accordance with claim 23 wherein:

the at least one perforation is tapered such that the opening in the liner closer to the lid is smaller than the opening in the liner on the side away from the lid.

* * * * *